US005593699A

United States Patent [19]

Grassi

[11] Patent Number: 5,593,699

[45] Date of Patent: Jan. 14, 1997

[54] APPARATUS FOR MANUFACTURING FORM-FITTING INSOLES

[75] Inventor: Silvano Grassi, Biadene Di Montebelluna, Italy

[73] Assignee: Sponsor S.n.c. di Grassi & C., Biadene Di Montebelluna, Italy

[21] Appl. No.: 446,975

[22] Filed: May 22, 1995

[51] Int. Cl.[6] ..... B29D 31/50

[52] U.S. Cl. ..... 425/2; 249/53 R; 249/120; 249/121; 249/171; 264/DIG. 30; 425/4 R

[58] Field of Search ..... 425/2, 4 R, 89; 249/53 R, 159, 171, 119, 120, 121, 139; 264/223, DIG. 30

[56] References Cited

U.S. PATENT DOCUMENTS

| | | | |
|---|---|---|---|
| 1,314,725 | 9/1919 | Young | 249/159 |
| 2,216,533 | 10/1940 | Kaplan | 425/2 |
| 2,333,481 | 11/1943 | Limmer | 425/2 |
| 3,320,347 | 5/1967 | Greenawalt | 264/223 |
| 4,450,122 | 5/1984 | Gallina | 249/121 |
| 4,747,989 | 5/1988 | Peterson | 425/2 |
| 5,027,461 | 7/1991 | Cumberland | 264/223 |

FOREIGN PATENT DOCUMENTS

| | | | |
|---|---|---|---|
| 0026897 | 4/1981 | European Pat. Off. . | |
| 0536055 | 4/1993 | European Pat. Off. . | |
| 978374 | 4/1951 | France | 249/53 R |

*Primary Examiner*—Robert Davis
*Attorney, Agent, or Firm*—Guido Modiano; Albert Josif

[57] ABSTRACT

An apparatus for manufacturing form-fitting insoles, including two trays on the bottom of each of which a piece of load-deformable fibrous spongy material is placed; the material is impregnated with a foaming reagent preparation and is covered in its upper region with a piece of double-stretch fabric treated so as to be impermeable, on which the user places his feet until the reaction is completed. The trays extend from separate box-like structures which are mutually associable by virtue of a retention pivot that allows mutual rotations about a vertical axis from a side-by-side position so as to move apart, and vice versa, and allows translatory motions along the same axis.

4 Claims, 2 Drawing Sheets

APPARATUS FOR MANUFACTURING FORM-FITTING INSOLES

BACKGROUND OF THE INVENTION

The present invention relates to an improved apparatus for manufacturing form-fitting insoles.

A process for manufacturing form-fitting insoles is already known; it is disclosed in Italian patent no. 1,124,338 dated Oct. 9, 1979 and entails the following operating steps:

- placing a parallelepiped made of a fibrous spongy load-deformable material at the bottom of each one of a pair of adjacent trays that extend from a single structure;
- pouring into the trays a preparation that impregnates the spongy fibrous material and reacts, by foaming, in a sufficiently short time;
- covering the trays and the above described components with a double-stretch piece of fabric treated so as to be impermeable, which is kept stretched by an appropriate frame;
- placing the user's feet on the fabric inside the trays, so as to deform both the fabric and the fibrous spongy material;
- waiting through the reaction time of the preparation, so that the produced shape remains subsequently unchanged;
- removing the unfinished products thus obtained and trimming them so as to leave only the impression of the sole of the foot, adapting it to the shoe in which it is to be inserted.

Although this method is technically very valid, also in view of the state of the art prior to its invention, it has been found to be limited in its potential by the means used to execute it.

The two trays in fact extend from a single structure and are therefore rigidly coupled to each other, forcing the user to place his feet parallel to each other, totally altering the normal standing position in which, depending on the individual person, the toes diverge by a greater or smaller extent according to a so-called abduction angle.

Placing one's feet in the trays in an unnatural position generates tensions that deform the sole of the foot, so that the impression can assume an incorrect shape.

Another limitation to the process described above is due to the apparatus and is constituted by the co-planar arrangement of the two trays.

It is in fact known that in a person whose legs are abnormally long or short or have different lengths, the upright posture causes a series of skeletal and postural adjustments (deviations, torsions, flexions, etcetera) which are aimed at compensating for the abnormality to achieve satisfactory equilibrium.

This naturally also affects the shape of the sole of the feet (and the different position of one with respect to the other), and the execution of the process with co-planar trays makes it impossible to produce a physiologically correct impression that is capable of making the person maintain a posture that compensates for the abnormality.

SUMMARY OF THE INVENTION

A principal aim of the present invention is therefore to provide an apparatus that is capable of carrying out in an optimum manner the above described process for manufacturing form-fitting insoles.

A consequent primary object is to provide an apparatus which is very simple.

Another object is to provide an apparatus that allows to obtain a product of higher quality.

This aim, these objects, and others which will become apparent hereinafter are achieved by an improved apparatus for manufacturing form-fitting insoles, of the type which comprises two trays on the bottom of each of which a piece of load-deformable fibrous spongy material is placed, said material being impregnated with a foaming reagent preparation and being covered in its upper region with a piece of double-stretch fabric treated so as to be impermeable on which the user places his feet until the reaction is completed; characterized in that said trays extend from separate box-shaped structures which are mutually associable by virtue of retention means that allow mutual rotary motions about a vertical axis from a side-by-side position so as to move apart, and vice versa, and allow translatory motions along the same axis.

BRIEF DESCRIPTION OF THE DRAWINGS

Further characteristics and advantages of the invention will become apparent from the following detailed description of an embodiment thereof, illustrated only by way of non-limitative example in the accompanying drawings, wherein.

DESCRIPTION OF THE PREFERRED EMBODIMENTS

Figure 1:
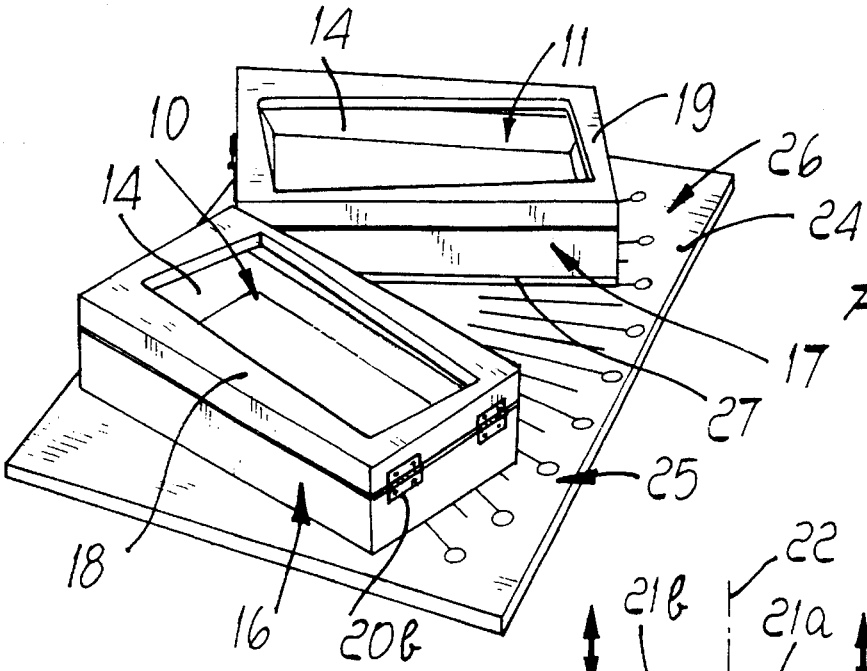
FIG. 1 is a perspective view of the apparatus according to the present invention.
Figure 2:
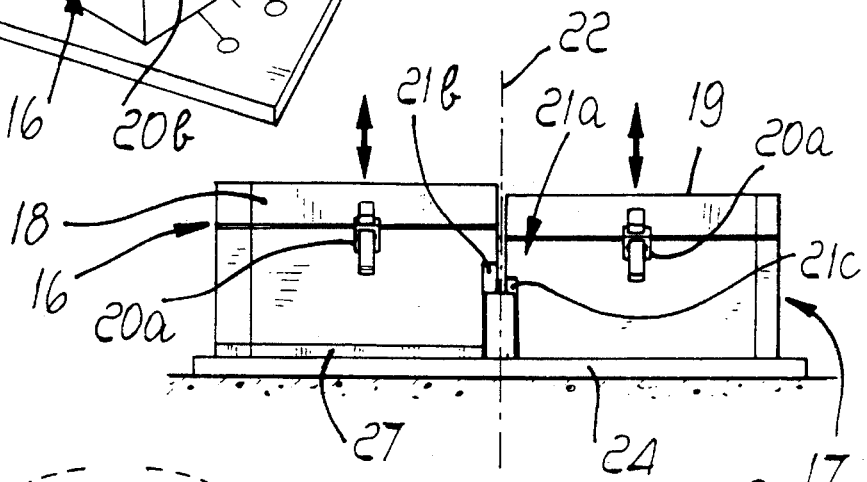
FIG. 2 is a front view of the apparatus.
Figure 3:
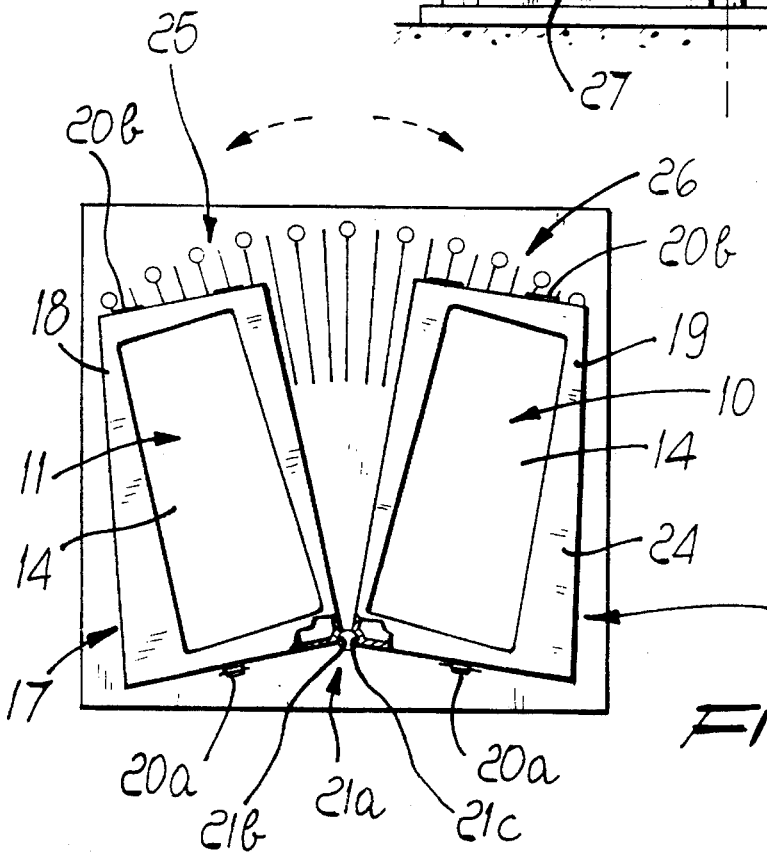
FIG. 3 is a top view of the apparatus.
Figure 4:
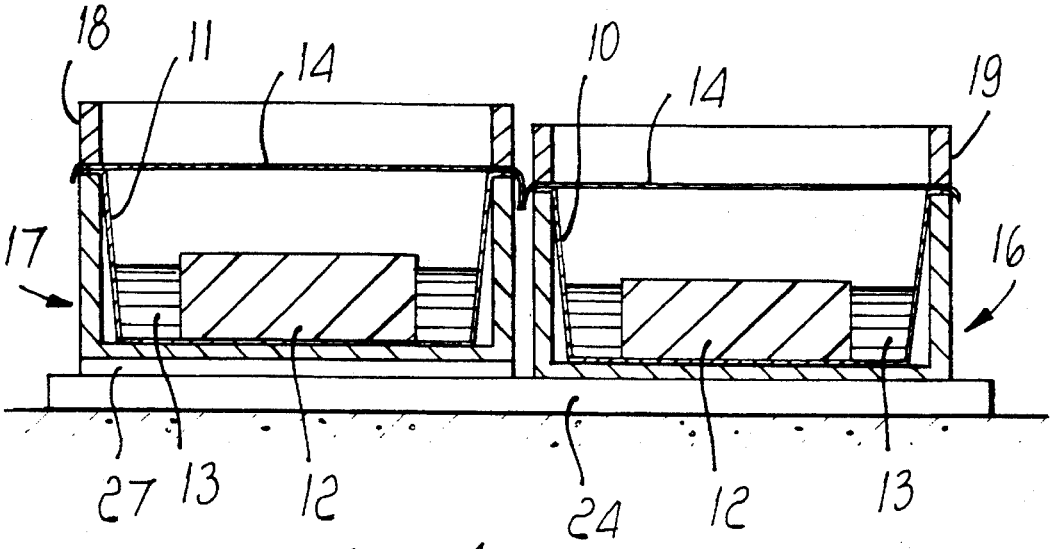
FIGS. 4 and 5 are sectional views of the apparatus in two active steps of the process for manufacturing insoles.
Figure 5:
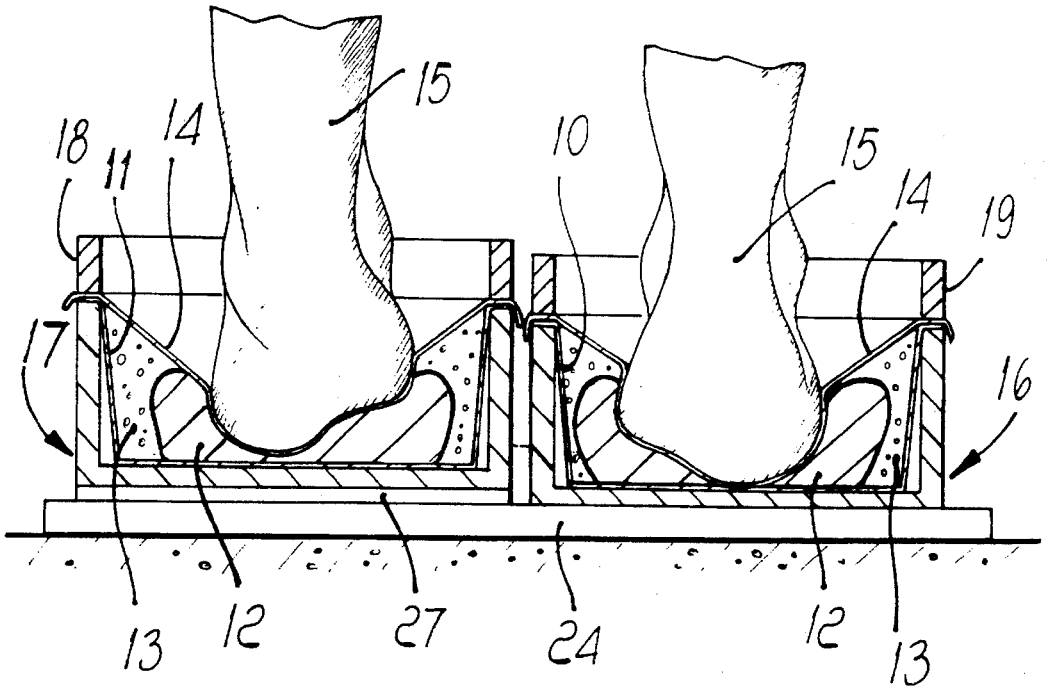

With reference to the above figures, an improved apparatus according to the invention comprises two trays made of plastics, designated by the reference numerals 10 and 11 respectively; a piece of load-deformable fibrous spongy material 12 is placed on the bottom of each one of said trays, is impregnated with a foaming reagent preparation 13, and covered in its upper region with a piece of double-stretch fabric 14, treated so as to be impermeable, on which the user places his foot 15 until the reaction has completed.

Each tray 10 and 11 is accommodated in a box-shaped structure, respectively 16 and 17, which is preferably made of wood; a frame, respectively 18 and 19, is placed on the upper rim of said structure and is fixed by means of hooks 20*a* and hinges 20*b* so as to keep the piece of fabric 14 stretched.

The box-shaped structures 16 and 17 can be arranged side by side and be mutually associated on a base 24 with a snug-fit coupling by virtue of a vertical pivot 21*a* that allows mutual rotations about a vertical axis, designated by the reference numeral 22, from a side-by-side configuration so as to move apart, and vice versa, as well as translatory motions along the same axis.

The snug-fit coupling occurs by virtue of the presence of corresponding semicylindrical vertical slots 21*b* and 21*c* in corner regions of the box-shaped structures 16 and 17.

It is also possible to provide fixing means, not shown in the figures for the sake of simplicity (for example hooks, screws, etcetera) which are suitable to make the two structures 16 and 17 assume a given mutual position.

As mentioned, the base 24 cooperates with said box-shaped structures and has a double locator graduation 25 and 26 for exact mutual placement according to the abduction angle of the feet of the user.

In practice, the user is placed on a suitable graduated base, not shown, and the abduction angle is measured for each foot; then the trays 10 and 11 are arranged at the same angle by positioning them on the base 24.

Shims 27 also cooperate with the structure and are meant to be positioned on the base 24 to achieve exact mutual positioning according to the difference in the length of the legs, measured with a known apparatus that is not shown.

Accordingly, the two trays 10 and 11 are placed at different elevations with respect to the base 24, for example so that one rests directly on said base and one rests on shims 27.

At this point the apparatus is ready to perform, in an optimum manner, the process for manufacturing form-fitting insoles, which consists in placing the user so that his feet are on the piece of fabric 14 of each tray 10 and 11, so as to deform both the fabric and the fibrous spongy material 12; in waiting through the reaction time of the preparation, so that the shape given to it subsequently remains unchanged; in removing the unfinished products thus obtained; and in trimming them until only the impression-insole is left, adapting it to the shoe in which it must be inserted.

In practice it has been observed that the above described apparatus has achieved the intended aim and objects of the present invention.

The invention thus conceived is susceptible of numerous modifications and variations, all of which are within the scope of the inventive concept.

All the details may furthermore be replaced with other technically equivalent elements.

In practice, the materials employed, so long as they are compatible with the contingent use, as well as the dimensions, may be any according to the requirements.

What is claimed is:

1. Apparatus for manufacturing form-fitting insoles, comprising:

two trays, each of said trays defining an inner cavity, said cavity comprising a bottom;

a piece-shaped load-deformable fibrous spongy material, a piece of said material being placed on the bottom of each of said trays;

a foaming reagent preparation, said reagent preparation being impregnated in said spongy material placed in said trays for reacting with said material;

an impermeable double-stretch fabric, said fabric being extended on said cavities to cover an upper surface of said piece-shaped spongy material impregnated with said reagent preparation;

box-shaped structures for supporting said trays;

retention means for connecting said box-shaped structures;

said retention means defining a vertical axis thereof, and said box-shaped structures being rotatable about said vertical axis to move between a position whereat they are spaced apart and a position in which they are positioned side-by-side, said box-shaped structures being further movable to execute translatory motions along said axis, wherein a user places himself with his feet on said impermeable fabric until reaction between said spongy material and said reagent preparation is completed.

2. Apparatus according to claim 1, wherein a locator base for exact mutual positioning according to the abduction angle of the user's feet cooperates with said box-shaped structures.

3. Apparatus according to claim 2, wherein shims cooperate with said box-shaped structures and are positionable on said locator base to achieve exact mutual positioning according to a difference in length of the legs.

4. Apparatus according to claim 3, wherein frames are placed on each one of said box-shaped structures, said frames being fixed to rims thereof through hinges and hooks so as to keep the respective double-stretch impermeable fabrics stretched.

* * * * *